United States Patent [19]

Muko et al.

[11] Patent Number: 4,834,845

[45] Date of Patent: May 30, 1989

[54] PREPARATION OF ZN-NI ALLOY PLATED STEEL STRIP

[75] Inventors: Ryoichi Muko; Kazuo Mochizuki; Hajime Kimura; Toshio Ichida; Shigeru Kobayashi, all of Chiba, Japan

[73] Assignee: Kawasaki Steel Corp., Tokyo, Japan

[21] Appl. No.: 236,660

[22] Filed: Aug. 25, 1988

[30] Foreign Application Priority Data

Aug. 28, 1987 [JP] Japan ..... 62-214424

[51] Int. Cl.[4] ..... C25D 7/06

[52] U.S. Cl. ..... 204/28

[58] Field of Search ..... 204/28

[56] References Cited

U.S. PATENT DOCUMENTS 4,313,802 2/1982 Shibuya ..... 204/28

*Primary Examiner*—T. M. Tufariello

*Attorney, Agent, or Firm*—Bierman and Muserlian

[57] ABSTRACT

A zinc-nickel alloy is electrodeposited on a steel strip by passing the steel strip through a stream of sulfuric acid-containing plating solution which contains 2-3 mol/-liter in total of $Zn^{2+}$, $Ni^{2+}$, $H^+$, and $SO_4^{2-}$ ions and at least 0.1 mol/liter of $Na^+$, $K^+$, or $NH_4^+$ ion at pH 1 to 2.5, feeding the solution at a flow speed of at least 1 m/sec., and applying electricity between the strip and an anode in the solution such that the current density between the strip and the anode at the outlet of the solution is lower than that at the inlet of the solution. The anode may preferably be divided into a plurality of segments. This process may be carried out by use of a radial or horizontal cell.

4 Claims, 4 Drawing Sheets

PREPARATION OF ZN-NI ALLOY PLATED STEEL STRIP

BACKGROUND OF THE INVENTION

1. Field of the Invention

This invention relates to a process for producing a zinc-nickel alloy plated steel strip. More particularly, it relates to a process for commercially plating a zinc-nickel alloy on a steel strip at from a low line speed to a high line speed in a consistent manner.

2. Prior Art and Problems

Zinc-nickel (Zn-Ni) alloy plating is several times to ten several times more resistant to corrosion than zinc (Zn) plating in the same coating weight on steel strips. In these years, the zinc-nickel alloy plating is thus used in an increasing amount. In order that a zinc-nickel alloy plating exhibit high corrosion resistance, the plating must be controlled to have a nickel content of 10 to 15% by weight because the best corrosion resistance is accomplished in the range where the alloy assumes the $\gamma$ phase of $Ni_5Zn_{21}$ solid solution among various Zn-Ni alloy phases. Plating having a composition beyond this range have a too noble galvanic potential and the sacrificial corrosion prevention thereof to the steel strip is rather lowered.

Various plating conditions must be controlled before a steel strip plated with a Zn-Ni plating having a nickel content of 10 to 15% by weight can be consistently prepared in high quality. Generally it is required to keep constant such plating parameters as plating current density, and the composition, flow speed, and temperature of plating solution. Additional control must be done before a large quantity of Zn-Ni plated strip can be commercially produced at a low cost. It is necessary to produce plated strips at a high line speed. It is also necessary to maintain their quality constant despite a variation in line speed and current density.

Plating must be carried out at a high current density in order to deposit a desired Zn-Ni alloy at a high line speed, because the weight of alloy electrodeposited depends on the product of current density and plating time. As the current density becomes higher, the voltage across the anode-to-strip resistance, that is, the resistance of plating solution occupies a larger proportion relative to the entire plating voltage. Then the electric conductivity of the plating solution must be increased in order to reduce the cost of steel strip plating operation.

Several techniques are known in the art which aim at commercial operation of Zn-Ni alloy plating at a high current density. With respect to operating conditions, Japanese Patent Application Kokai No. 55-152194 discloses to set the relative speed of plating solution and steel strip to at least 20 m/min. With respect to plating equipment, Japanese Patent Publication No. 61-21319 discloses a horizontal electrolysis equipment in which the distance between an anode and a steel strip to be plated, that is, anode-to-strip distance is reduced. With respect to plating bath, Japanese Patent Application Kokai No. 61-133394 discloses a plating solution having a certain amount of supporting electrolyte added. With respect to the electric conductivity of plating solution, Japanese Patent Publication No. 61-19719 discloses to add controlled amounts of $ZnSO_4$ and $NiSO_4$ to a plating solution to increase the electric conductivity thereof. As to a technique for maintaining a consistent quality independent of a variation in manufacturing parameters such as line speed and current density, Japanese Patent Publication No. 60-106992 proposes to add an ammonium ion to a plating solution to reduce curent density dependency.

These techniques, however, are not fully satisfactory in practice under advanced plating conditions as typified by a high line speed of at least 100 m/min. and a high current density of 100 to 250 A/dm$^2$ (ampere per square decimeter). The reasons are explained below. First, it is difficult to control the composition of a plating layer under such plating conditions wherein the current density is extremely higher than the normal range of 5 to 10 A/dm$^2$, because the deposition mechanism changes into an abnormal machanism wherein electrochemically less noble zinc preferentially deposits and thus there deposits a plating layer which has a composition different from that of the plating solution. Secondly, it is difficult to suppress an increase of power consumption due to a rise of plating voltage. In addition, there remain unsolved such problems as the influences of oxygen gas and Joule heat generating during high current density plating on the composition of alloy then plated.

In addition, with a processing line in a manufacturer work wherein current density is changed depending on the width of a steel strip to be plated and the desired weight of alloy deposited, it is more difficult to consistently produce a plating of desired quality because the composition of the plating layer depends on current density.

The influence of oxygen gas evolving in the plating solution during plating means the phenomenon that oxygen gas which evolves in direct proportion to an increase of current density causes the nickel content of a Zn-Ni alloy plating to increase, eventually failing to consistently produce a Zn-Ni alloy plating having a predetermined nickel content. In fact, as seen from FIG. 5 showing the relationship between the amount of oxygen gas contained in plating solution and the percentage increase of nickel content in the plating layer, the nickel content of the plating layer drastically increases when the fraction of oxygen gas contained in plating solution exceeds 10%. For the measurements from which FIG. 5 is plotted, a plating solution which contained 2.9 mol/liter in total of $Zn^{2+}$, $Ni^{2+}$, $H^+$ and $SO_4^{2-}$ ions, 0.2 mol/liter of $Na^+$, and 0.2 mol/liter of $K^+$ at pH 1.8 was used.

First, the influence of oxygen gas is described in detail.

The influence of oxygen gas varies with a line speed. It is thus difficult to consistently produce a Zn-Ni alloy plating having a nickel content of 10–15% by weight with line speeds in the range of from 10 to 300 m/min.

An experiment was carried out to examine the influence of oxygen gas. A plating system included ten series connected radial plating cells and an anode of 2 m long. A plating solution contained 4 mol/liter in total of $Zn^{2+}$, $Ni^{2+}$, $H^+$ and $SO_4^{2-}$ ions at pH 2.0. Plating was carried out on a steel strip while passing the solution at a temperature of 60° C. and a flow speed of 0.5 m/sec. The results are plotted in FIG. 3 in which the nickel content was plotted as a function of a line speed for different current densities. As seen from FIG. 3, the plating layer drastically changes its nickel content when the line speed or current density is changed. There were often formed plating layers whose nickel content fell outside the preferred range of from 10 to 15% by weight.

The influence of oxygen gas becomes outstanding particularly with a plating cell which is designed to have a reduced anode-to-strip distance in order to carry out plating at a high current density of 100 to 250 $A/dm^2$ with a minimal plating voltage as disclosed in Japanese Patent Publication No. 61-21319. Since the plating cell having a reduced anode-to-strip distance generally uses an anode in the form of an insoluble electrode, it is imperative that oxygen gas evolves and an amount of oxygen gas existing on the plating surface increases during plating, as will be described later in further detail.

The influence of Joule heat generating during high current density plating means the phenomenon that the amount of Joule heat generated at a high current density increases the temperature of plating solution so that the temperature of plating solution is not maintained constant between the anode and the strip, failing to consistently produce a plating of a predetermined composition.

An experiment was made to examine the influence of Joule heat during plating. The anode used was 1 m long and spaced a distance of 10 mm from a steel strip. A plating solution having the same composition and pH as that used in FIG. 5 and an electric conductivity of 100 mS/cm was passed at a flow speed of 0.5 m/sec. In FIG. 6, an increase in temperature of the plating solution was plotted as a function of a plating current density. The increase in temperature of the plating solution is a difference between the temperatures of plating solution at the outlet and the inlet of the cell. As seen from FIG. 6, the temperature of plating solution is increased by 4° to 13° C. when the plating current density is 100 to 180 $A/dm^2$.

As described above, the influences of oxygen gas and Joule heat associated with high current density plating must be overcome in order to commercially carry out Zn-Ni alloy plating at a high line speed in a consistent manner.

It is also necessary to use a plating solution having a low viscosity. The use of a highly viscous plating solution inevitably invites a problem of drag-out that part of plating solution is taken out with a steel strip, resulting in a waste of relatively expensive nickel and hence, an increase of plating cost. The viscous solution promotes the stagnation of oxygen gas in plating solution as mentioned above. For these reasons, a plating solution having a low viscosity is preferred.

SUMMARY OF THE INVENTION

An object of the present invention is to provide a process for consistently plating a Zn-Ni alloy on a steel strip at from a low line speed to a high line speed in a commercial mass-production scale at a low cost.

Another object of the present invention is to provide a process for consistently plating a Zn-Ni alloy on a steel strip at a high current density and a high line speed such that the influences of oxygen and Joule heat on the composition of the alloy plating are minimized whereby a plating of desired quality is produced independent of a change in line speed and current density.

A further object of the present invention is to provide a compact plating line by extending the length of an anode in each cell to reduce the number of cells in the plating line.

According to the first aspect of the present invention, there is provided a process for producing a zinc-nickel alloy plated steel strip, comprising the steps of:

passing a steel strip through a stream of acidic plating solution which contains Zn and Ni ions and sulfuric acid at pH 1 in which the total of $Zn^{2+}$, $Ni^{2+}$, $H^+$, and $SO_4^{2-}$ ions ranges from 2 to 3 mol/liter, and at least one cation selected from the group consisting of $Na^+$, $K^+$, and $NH_4^+$ ions is present in an amount of at least 0.1 mol/liter, the stream flowing at a speed of at least 1 m/sec., and applying electricity between the strip and an anode in the solution such that the current density between the strip and the anode at the outlet of the solution is lower than that at the inlet of the solution, thereby plating a zinc-nickel alloy on the steel strip.

According to the second aspect of the present invention, there is provided a process for producing a zinc-nickel alloy plated steel strip using at least one cell, each having a plurality of segments of anode, comprising the steps of:

passing a steel strip through a stream of acidic plating solution which contains Zn and Ni ions and sulfuric acid at pH 1 to 2.5, in which the total of $Zn^{2+}$, $Ni^{2+}$, $H^+$, and $SO_4^{2-}$ ions ranges from 2 to 3 mol/liter, and at least one cation selected from the group consisting of $Na^+$, $K^+$, and $NH_4^+$ ions is present in an amount of at least 0.1 mol/liter, the stream flowing at a speed of at least 1 m/sec., and applying electricity between the strip and the anode in the solution such that the current density between the strip and the anode segment at the outlet of the solution is to 5 from 20% lower than the anode segment at the inlet of the solution, thereby plating a zinc-nickel alloy on the steel strip.

Above described processes may be carried out by use of a radial or horizontal cell.

BRIEF DESCRIPTION OF THE DRAWINGS

The above and other objects, features, and advantages of the present invention will be better understood from the following description taken in conjunction with the accompanying drawings, in which.

FIGS. *7a*, *7b*, and *7c* show different states bubbles take between an anode and a steel strip; and FIGS. *8a* and *8b* show the states of steel strip surfaces at different line speeds.

DESCRIPTION OF THE INVENTION

Figure 1:
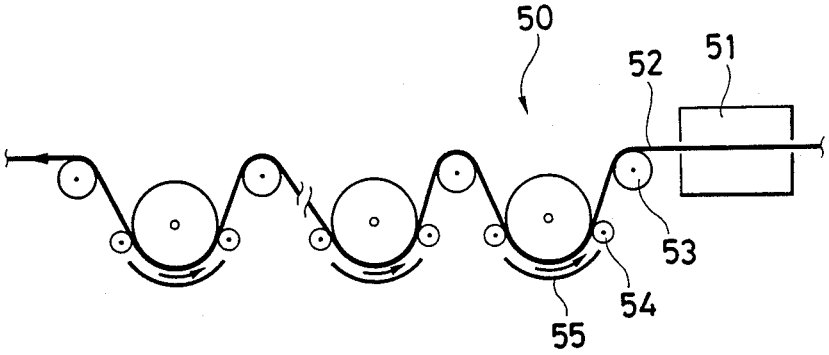
FIG. 1 is a schematic view of a plating line to which the present invention is applicable.

A typical plating line system is shown in FIG. 1 as comprising ten radial plating cells although only the three cells are shown in FIG. 1. The system 50 includes a degreasing/pickling unit 51, a series of deflector rolls 53, and a series of winding rolls which carry a steel strip. A pair of conductor rolls 54 are in rotating contact with each winding roll. An arch-shaped anode 55 is opposed to each winding roll and radially spaced a predetermined distance therefrom. The anode 55 has such a circumferential or longitudinal length that it covers the area of a steel strip passing the cell. A steel strip 52 to be plated is passed from the right to the left as shown by a solid arrow in FIG. 1, through the degreasing/pickling unit 51, and then around the deflector rolls 53 and the winding rolls alternately in a serpentine manner. A plating solution is passed through the space between the winding roll or strip and the anode in various flow modes, for example, in a counter-flow.

Figure 7A:
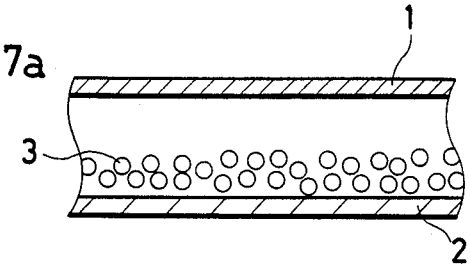
Figure 7B:
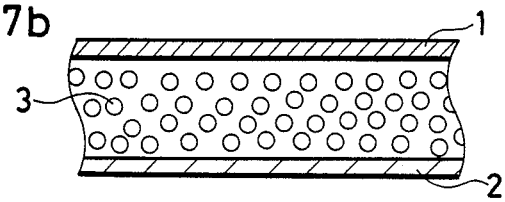
Figure 7C:
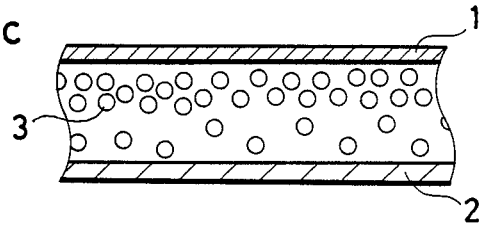

Studying various problems associated with plating at a high current density, particularly the influence of oxygen evolving on an anode, we have found that bubbles are distributed in plating solution between the anode and a steel strip in three different states. As shown in FIG. 7, bubbles 3 start floating toward a steel strip 1 from an anode 2 in FIG. *7a*, bubbles 3 are entirely dispersed between the steel strip 1 and the anode 2 in FIG. *7b*, and bubbles 3 are partially floating near the steel strip 1 in FIG. *7c*. In the state where bubbles start floating, the bubbles do not affect the nickel content of a plating layer. With bubbles entirely dispersed, inclusion of 10% of oxygen gas in plating solution causes an increase in the nickel content of a plating layer. In the state where bubles are floating, inclusion of even 2% of oxygen gas in plating solution causes an increase in the nickel content of a plating layer. That is, the difference between the entirely dispersed state (FIG. *7b*) and the partially floating state (FIG. *7c*) is meant by the amount of oxygen gas in proximity to a steel strip surface plated.

These three states are created depending on the flow speed of plating solution, the length of the anode, and plating current density. In general, when the flow speed of plating solution is high and the anode is as short as less than 30 cm, evolving bubbles are moved past the cell before they are entirely dispersed between the anode and the strip. Thus the bubbles remain in the beginning of floating, and never reach the entirely dispersed or floating state. In contrast, when the flow speed of plating solution is relatively low and the anode is long, bubbles are entirely dispersed. With a further low flow speed of plating solution, bubbles reach the floating state.

Figure 8A:
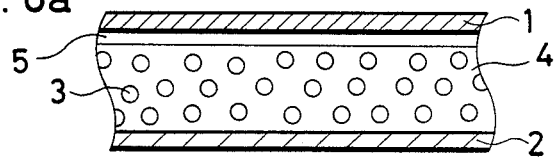
Figure 8B:
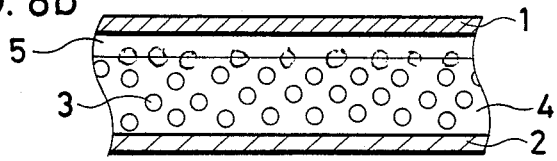

The change of state of bubbles also depends on line speed. As shown in FIGS. 8*a* and 8*b*, the change of line speed affects the thickness of concentration boundary layer 5 that is followed by affecting nickel content in a plating layer. Under the operation at high current density and high line speed shown in FIG. 8*a*, the concentration boundary layer becomes thinner, in contrast therto, under the condition at high current density and low line speed shown in FIG. 8*b*, the concentration boundary layer becomes thicker. Thus the influence of oxygen gas on line speed is significant.

Studying the distribution of bubbles in the three different states in an actual processing line, we have found the following. In an actual processing line, the anode is as long as 50 cm or more and the plating solution forms a turbulent flow. Bubbles evolving from the anode are dispersed by the action of turbulent flow. In the plating solution between the anode and the steel strip, few bubbles are at the start of floating and the majority of bubbles are in the entirely dispersed or floating state. When the plating cell has an anode of longer than 1 m, bubbles are present in either of two states, entirely dispersed state or floating state, in a direction of flow of plating solution. The region of bubble floating state is formed in proximity to the outlet of plating solution from the cell. As the flow speed of plating solution is increased or the viscosity of plating solution is reduced, the turbulent flow is enhanced so that the bubble floating region is reduced in length.

Even when the bubble entirely dispersed state which has less influence on the composition of a plating layer than the bubble floating state is established in proximity to the outlet of plating solution as a result of promoted turbulent flow of plating solution due to its increased flow speed, the influence of oxygen gas on the composition of a plating layer is not fully minimized because a great amount of oxygen gas is contained in the solution. The influence of oxygen gas can be minimized by reducing the current density at the outlet of plating solution.

We have also found that the influence of Joule heat can be minimized by increasing the electric conductivity and flow speed of plating solution.

Based on these findings, we come to the conclusion that the influences of oxygen gas and Joule heat generating during plating can be minimized by using a plating solution having a low viscosity and a high electric conductivity, increasing the flow speed of the solution such that the solution forms a fully turbulent flow between the anode and the steel strip, and reducing the current density between the anode and the steel strip at the outlet of the solution.

The present invention thus provides a process for plating a zinc-nickel alloy on a steel strip in an acidic plating solution containing Zn and Ni ions and sulfuric acid, characterized in that the solution has pH 1 to 2.5, contains 2 to 3 mol/liter of $Zn^{2+}$, $Ni^{2+}$, $H^+$, and $SO_4^{2-}$ ions in total, and at least 0.1 mol/liter of at least one cation selected from the group consisting of $Na^+$, $K^+$, and $NH_4^+$ ions, the solution is passed at a flow speed of at least 1 m/sec., and the current density between the strip and an anode at the outlet of the solution is lower than that at the inlet of the solution. The anode may be divided into two or more segments in each cell. The current density between the strip and an anode segment at the outlet of the solution is to 5 from 20% lower than an anode segment at the inlet of the solution.

The present invention will be described in further detail.

The plating solution used in the process of the present invention is an acidic plating solution which has pH 1 to 2.5 and contains 2 to 3 mol/liter in total of $Zn^{2+}$, $Ni^{2+}$, $H^+$, and $SO_4^{2-}$ ions and at least 0.1 mol/liter of at least one cation selected from the group consisting of $Na^+$, $K^+$, and $NH_4^+$ ions.

These applicable amounts are known in Japanese Patent Application No. 62-026011 in which is disclosed the reasons to define such amounts. With pH less than 1, when Zn-Ni alloy plating is carried out in the actual line, considerably melted iron out of a steel strip is present in the plating solution in the form of impure ion. More than 2.5 pH is not practical. When continuous plating operation is carried out with more than pH 2.5, nickel content in the Zn-Ni alloy plating layer varies with the wide change of pH given rise thereto.

With respect to the total concentration of $Zn^{2+}$, $Ni^{2+}$, $H^+$ and $SO_4^{2-}$ ions, the concentration less than 2 mol/litter results in burning of plating when Zn-Ni alloy plating is carried out. The concentration more than 3 mol/litter makes conductive aids less effective in improvement in electric conductivity.

With the conductive aids less than 0.1 mol/litter, ample conductivity cannot be obtained. The conductive aids may be added to solubility limit thereof.

$Zn^{2+}$, $Ni^{2+}$, $H^+$ and $SO_4^{2-}$ are generally introduced into the solution in the form of $ZnSO_4$, $NiSO_4$ and $H_2SO_4$.

The additional cations of $Na^+$, $K^+$ and $NH_4^+$ are generally introduced into the solution in the form of conductive aids such as $Na_2SO_4$, $K_2SO_4$ and $(NH_4)_2SO_4$.

This plating solution, disclosed in Japanese Patent Application No. 62-026011 by the present inventors, is advantageous because of its low viscosity and high electric conductivity. More particularly, because of its low viscosity, the plating solution is likely to form a turbulent flow, suppressing formation of the bubble floating state which tends to affect the nickel content of a plating layer. The influence of oxygen gas evolving during on-line processing at a high current density of 100 to 250 A/dm$^2$ is thus minimized. Because of its high electric conductivity, the plating solution allows the plating voltage to be lowered so that a smaller amount of Joule heat is produced.

The flow speed of the plating solution is set at 1 m/sec. or higher. With a flow speed of less than 1 m/sec., a fully turbulent flow cannot be formed between the anode and the strip, allowing oxygen gas evolving during plating to greatly affect the composition of a plating layer. Then the nickel content of the plating layer is largely varied with the line speed and current density. The flow speed has no special upper limit, but the range up to 3 m/sec may be in practical use.

Figure 4:
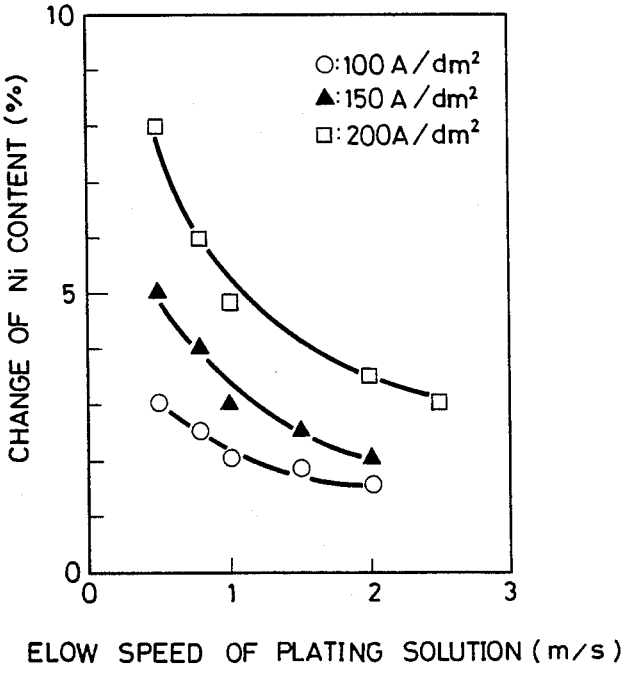
FIG. 4 is a diagram showing the change of nickel content of a plating as a function of the flow speed of plating solution for different line speeds of 10 and 300 m/min.
Figure 5:
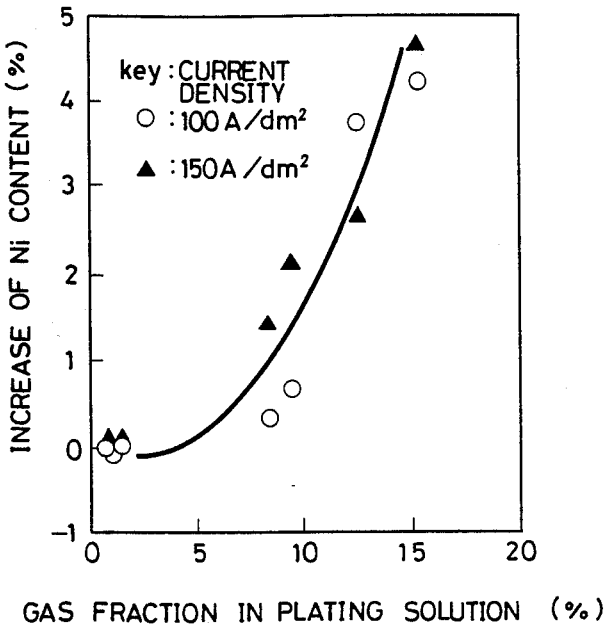
FIG. 5 is a diagram showing the percent increase of nickel content of a plating as a function of gas fraction in plating solution.
Figure 6:
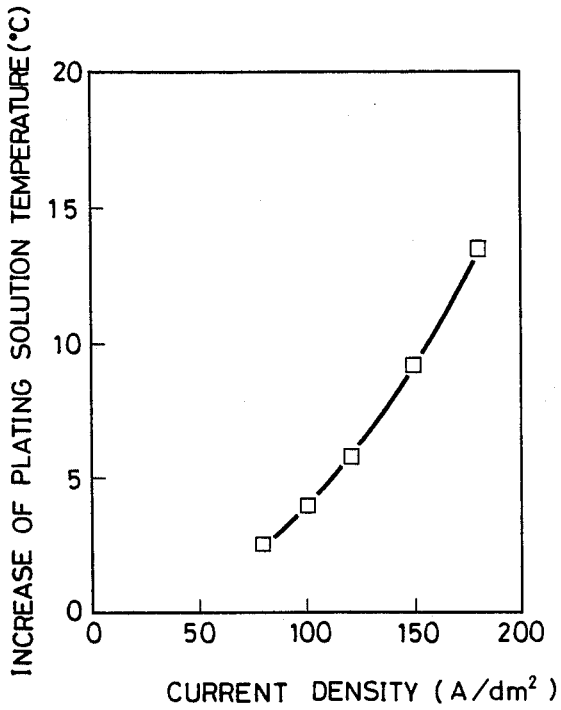
FIG. 6 is a diagram showing an increase of plating solution temperature due to Joule heat as a function of current density.

This observation is based on FIG. 4. An experiment was made in a plating system which included ten radial plating cells. A plating solution was passed between an anode and a steel strip, which contained 2.9 mol/liter in total of $Zn^{2+}$, $Ni^{2+}$, $H^+$, and $SO_4^{2-}$ ions, 0.2 mol/liter of $Na^+$, and 0.2 mol/liter of $K^+$ at pH 1.8. Plating was carried out at two different line speeds of 10 m/min. and 300 m/min. The nickel content of a plating layer was determined while changing the flow speed of plating solution. A difference in nickel content was plotted in FIG. 4 as a function of the flow speed of plating solution. As seen from FIG. 4, the nickel content experiences a great change at a flow speed of less than 1 m/min. whereas the nickel content experiences only a change of less than 5% at a flow speed of higher than 1 m/min.

It is important in the practice of the present invention that the current density between the strip and the anode at the outlet of the solution is lower than that at the inlet of the solution. This distribution of current density suppresses the influence of oxygen gas which is contained in the plating solution in a larger amount at the outlet of the solution. The extent and manner of reducing the current density at the outlet of the solution depend on various factors including the flow speed and viscosity of the plating solution, the anode-to-strip distance, and the length of the anode. In general, the current density at the outlet of the solution is preferably reduced 5 to 20% from the current density at the inlet of the solution when the latter ranges from 100 to 250 A/dm$^2$. With the reduction less than 5%, the change of nickel content due to the change of line speed exceeds an influence of such reduction, that is, such reduction becomes in vein. When the reduction is more than 20%, there occurs undesirable plating such having different nickel content in each anode or anode segment, resulting in a laminar structure in a direction of thickness of plating layer.

The current density may be reduced continuously or stepwise. In the latter case, the current density may be discontinuously reduced at the outlet of the plating solution.

The current density at the outlet of the plating solution may be reduced, for example, by longitudinally dividing the anode into two or more segments and applying electricity to them at different current densities.

The current density at the inlet of the plating solution is generally set to the current density required for high line speed plating. Better results are obtained when the current density at the inlet of the plating solution is in the range of 100 to 250 A/dm$^2$.

The plating cell used herein is not particularly limited, but is preferably of radial type. The radial cell has many features including a stable pass line, a minimized variation in the flow speed of plating solution, and minimized local concentration of electricity. These features are very advantageous particularly when plating is carried out at a reduced anode-to-strip distance.

The circumferential length of an anode in a single cell is not particularly limited. The present invention is more effective when the anode is at least 1 m long. With an anode of shorter than 1 m, especially of shorter than 30 cm, it hardly occurs that the bubble floating state is established between the anode and the strip and that the plating solution contains a greater amount of oxygen gas at the outlet of the solution.

Above explanation and illustration have been made by use of a radial type cell. However, the present invention is not limited thereto, and may be carried out by use of a horizontal cell.

EXAMPLES

Examples of the present invention are given below by way of illustration and not by way of limitation.

EXAMPLE 1

A plating line system as schematically illustrated in FIG. 1 was used in this example. The system contained ten radial plating cells. A plating solution was passed through the space between the strip or winding roll and the anode in a counter-flow mode. In FIG. 1, the left and right edges of the anode 55 are an inlet and an outlet for the plating solution, respectively. The plating solution was an acidic plating solution which had pH 1.8 and contained 2.9 mol/liter in total of $Zn^{2+}$, $Ni^{2+}$, $H^+$, and $SO_4^{2-}$ ions, 0.2 mol/liter of $K_2SO_4$, and 0.2 mol/liter of $Na_2SO_4$.

The anode of each cell was longitudinally divided into two segments each having a circumferential length of 1 m. The left and right segments are referred to as upstream and downstream segments respectively in connection with the flow direction of the plating solution. Electricity was applied so as to give a ratio of current density at the upstream anode segment to current density at the downstream anode segment of 1.05/0.95 (Current density difference is 10%).

The plating solution was passed at a flow speed of 2.0 m/sec. and maintained at a temperature of 60° C.

A steel strip was plated with a Zn-Ni alloy under these conditions while the line speed was changed from 10 to 300 m/min. and the current density was set to 100, 150, and 200 A/dm$^2$. The nickel content of the resulting deposit was determined.

Figure 2:
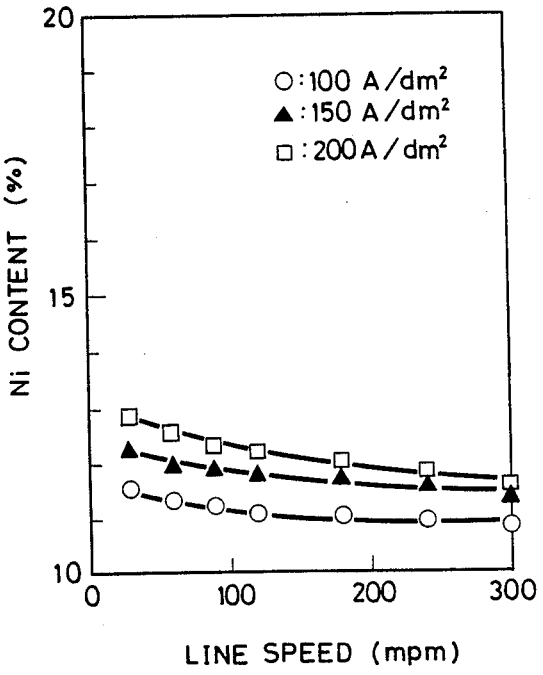
FIG. 2 is a diagram showing the nickel content of a plating as a function of the line speed of a steel strip for different current densities when plating is carried out according to the present invention.

The results are shown in FIG. 2.

EXAMPLES 2-9

The procedure of Example 1 was repeated except that the composition and flow speed of the plating solution, and current density distribution were changed as shown in Table 1. The results are shown in Table 1.

COMPARATIVE EXAMPLES 1-2

Plating was carried out by approximately the same procedure as in Example 1 except that the current density applied had no difference in the longitudinal direction of the anode. The plating conditions and the results are shown in Table 1.

Figure 3:
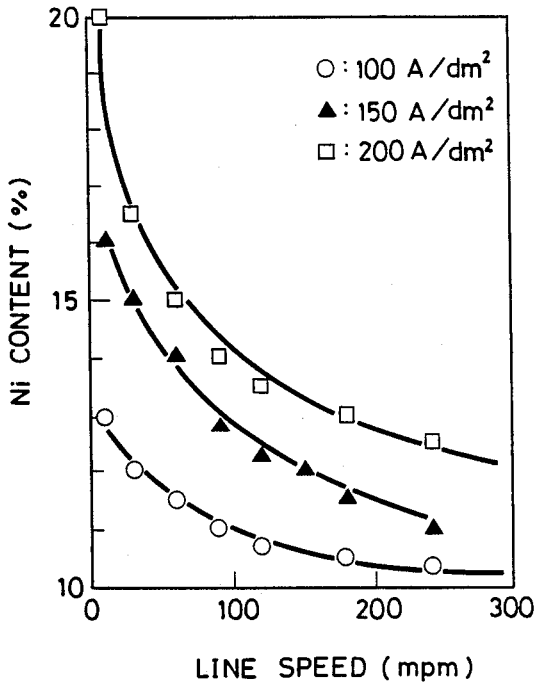
FIG. 3 is a diagram showing the nickel content of a plating as a function of the line speed of a steel strip for different current densities when plating is carried out according to the prior art technique.

The data of Table 1 and a comparison of FIG. 2 with FIG. 3 show that the platings deposited in the examples experienced a significantly small change in nickel content in relation to changes of current density and line speed as compared with the platings deposited in the comparative examples. The nickel content of the platings fell in the range of 10 to 15% by weight independent of changes of current density and line speed.

TABLE 1

| Example | Composition of Plating solution $[Zn^{2+}] + [Ni^{2+}] + [H^+] + [SO_4^{2-}]$ | Conductive aid | pH | Anode*1 Number of anode segments | Anode*1 Current density distribution (Inlet/Outlet) |
|---|---|---|---|---|---|
| Example 2 | 2.9 | $Na_2SO_4$ 0.1 mol/l<br>$K_2SO_4$ 0.1 mol/l | 1.8 | 2 | 1.05/0.95 (10%) |
| Example 3 | 2.9 | " | 1.8 | 4 | 1.05/1/1/0.95 (10%) |
| Example 4 | 2.5 | " | 1.8 | 2 | 1.05/0.95 (10%) |
| Example 5 | 2.0 | " | 1.8 | 2 | 1.05/0.95 (10%) |
| Example 6 | 3.0 | $Na_2SO_4$ 0.2 mol/l<br>$K_2SO_4$ 0.2 mol/l | 1.8 | 4 | 1.10/1.05/0.95/0.90 (18%) |
| Example 7 | 3.0 | " | 1.8 | 2 | 1.05/0.95 (10%) |
| Example 8 | 2.9 | $Na_2SO_4$ 0.2 mol/l | 1.8 | 2 | 1.03/0.97 (6%) |
| Example 9 | 2.9 | $(NH_4)_2SO_4$ 0.2 mol/l | 1.8 | 2 | 1.03/0.97 (6%) |
| Comparative Example 1 | 3.0 | $Na_2SO_4$ 0.2 mol/l<br>$K_2SO_4$ 0.2 mol/l | 1.8 | 1 | — |
| Comparative Example 2 | 4.0 | no | 2.0 | 1 | — |

| Example | Flow Speed of plating solution (m/sec.) | Difference of nickel content (%) between line speeds of 10 and 300 m/min. 100 A/dm$^2$*2 | 150 A/dm$^2$*2 | 200 A/dm$^2$*2 |
|---|---|---|---|---|
| Example 2 | 2 | 1.0 | 1.3 | 2.0 |
| Example 3 | 2 | 0.8 | 0.9 | 1.6 |
| Example 4 | 1 | 1.0 | 1.4 | 2.2 |
| Example 5 | 1 | 1.2 | 1.7 | 2.5 |
| Example 6 | 1.5 | 0.7 | 0.8 | 1.2 |
| Example 7 | 2 | 0.8 | 0.8 | 1.6 |
| Example 8 | 2 | 0.9 | 1.0 | 1.8 |
| Example 9 | 2 | 1.0 | 1.5 | 2.3 |
| Comparative Example 1 | 0.5 | 2.5 | 4.1 | 6.0 |
| Comparative Example 2 | 0.5 | 3.1 | 5.2 | 8.3 |

*1The total length of anode segments is 2 m.
*2Average plating current density

EFFECT OF THE INVENTION

When a Zn-Ni alloy is electro-deposited on a steel strip at a high current density, the process of the present invention can control the influence of oxygen gas and Joule heat generating during the electrodeposition process. The composition of the plating layer can be maintained at a desired nickel content in spite of a change in plating parameters including current density and line speed. The process of the present invention allows for commercial production of a Zn-Ni alloy plating of quality at from a low line speed to a high line speed in a consistent manner.

Even when the anode of each cell has a substantial length, the influence of oxygen gas evolving in the plating solution can be suppressed by reducing the current density between the anode and the steel strip in the flow direction of the plating solution. A Zn-Ni alloy plated steel strip of quality can be produced consistently. It is thus possible to fully extend the length of the anode per cell and consequently, to reduce the number of cells necessary in a plating line, ensuring that the plating line be compact.

We claim:

1. A process for producing a zinc-nickel alloy plated steel strip, comprising the steps of:

passing a steel strip through a stream of acidic plating solution which contains Zn and Ni ions and sulfuric acid at pH 1 to 2.5, in which the total of $Zn^{2+}$, $Ni^{2+}$, $H^+$, and $SO_4^{2-}$ ions ranges from 2 to 3 mol/liter, and at least one cation selected from the group consisting of $Na^+$, $K^+$, and $NH_4^+$ ions is present in an amount of at least 0.1 mol/liter, the stream flowing at a speed of at least 1 m/sec., and applying electricity between the strip and an anode in the solution such that the current density between the strip and the anode at the outlet of the solution is lower than that at the inlet of the solution, thereby plating a zinc-nickel alloy on the steel strip.

2. A process for producing a zinc-nickel alloy plated steel strip using at least one cell, each having a plurality of segments of anode, comprising the steps of:

passing a steel strip through a stream of acidic plating solution which contains Zn and Ni ions and sulfuric acid at pH 1 to 2.5, in which the total of $Zn^{2+}$, $Ni^{2+}$, $H^+$, and $SO_4^{2-}$ ions ranges from 2 to 3 mol/liter, and at least one cation selected from the group consisting of $Na^+$, $K^+$, and $NH_4^+$ ions is present in an amount of at least 0.1 mol/liter, the stream flowing at a speed of at least 1 m/sec., and applying electricity between the strip and said anode in the solution such that the current density between the strip and the anode segment at the outlet of the solution is to 5 from 20% lower than the anode segment at the inlet of the solution, thereby plating a zinc-nickel alloy on the steel strip.

3. A process claimed in claim 1 or 2 wherein said process is carried out by use of a radial cell.

4. A process claimed in claim 1 or 2 wherein said process is carried out by use of a horizontal cell.

* * * * *